US009895820B2

(12) United States Patent
Weiss

(10) Patent No.: US 9,895,820 B2
(45) Date of Patent: Feb. 20, 2018

(54) BREAD SLICING MACHINE HAVING AN ADVANCING DEVICE

(71) Applicant: R. Weiss Verpackungstechnik GmbH & Co. KG, Crailsheim (DE)

(72) Inventor: Reinald Weiss, Schopfloch (DE)

(73) Assignee: R. WEISS VERPACKUNGSTECHNIK GMBH & CO., Crailsheim (DE)

( * ) Notice: Subject to any disclaimer, the term of this patent is extended or adjusted under 35 U.S.C. 154(b) by 302 days.

(21) Appl. No.: 14/374,330

(22) PCT Filed: Jan. 24, 2013

(86) PCT No.: PCT/EP2013/051297
§ 371 (c)(1),
(2) Date: Jul. 24, 2014

(87) PCT Pub. No.: WO2013/110687
PCT Pub. Date: Aug. 1, 2013

(65) Prior Publication Data

US 2014/0366696 A1 Dec. 18, 2014

(30) Foreign Application Priority Data

Jan. 24, 2012 (DE) ..... 10 2012 100 588

(51) Int. Cl.
*B26D 7/32* (2006.01)
*B26D 7/06* (2006.01)
(Continued)

(52) U.S. Cl.
CPC ..... *B26D 7/06* (2013.01); *B26D 1/157* (2013.01); *B26D 5/00* (2013.01); *B26D 7/0625* (2013.01);
(Continued)

(58) Field of Classification Search
CPC ..... B26D 1/157; B26D 2007/011; B26D 2007/327; B26D 2210/06; B26D 5/00; B26D 7/06; B26D 7/0625; Y10T 83/2209
See application file for complete search history.

(56) References Cited

U.S. PATENT DOCUMENTS 805,482 A * 11/1905 McCroskey ..... B26D 7/016 83/437.4
2,168,612 A * 8/1939 Ahrndt ..... B26D 1/157 83/409
(Continued)

FOREIGN PATENT DOCUMENTS

DE 41 13 435 A1 10/1982
DE 44 39 641 C1 11/1995
(Continued)

OTHER PUBLICATIONS

PCT International Preliminary Report on Patentability, dated Aug. 7, 2014.
(Continued)

*Primary Examiner* — Stephen Choi
(74) *Attorney, Agent, or Firm* — Dority & Manning, P.A.

(57) ABSTRACT

An apparatus for cutting bread into slices includes at least one circular blade which rotates in a cutting plane and is guided between a feed section feeding the bread to be sliced to the blade and a removal section receiving the cut slices of bread. At least one advancing device advances the bread from the feed section towards the knife. The advancing device is designed such that, between two cutting instances, it advances the uncut bread and then withdraws it such that the actually exposed front end of the uncut bread is advanced across the cutting plane by an advance path greater than the predetermined slice thickness and is then withdrawn counter to the direction of advance of the bread.

7 Claims, 3 Drawing Sheets

(51) Int. Cl.

| | |
|---|---|
| ***B26D 5/00*** | (2006.01) |
| ***B26D 1/157*** | (2006.01) |
| *B26D 7/01* | (2006.01) |

(52) U.S. Cl.
CPC .. *B26D 2007/011* (2013.01); *B26D 2007/327* (2013.01); *B26D 2210/06* (2013.01); *Y10T 83/2209* (2015.04)

(56) References Cited

U.S. PATENT DOCUMENTS

| | | | | |
|---|---|---|---|---|
| 4,580,475 | A * | 4/1986 | Antonissen | B26D 5/20 83/278 |
| 4,934,232 | A * | 6/1990 | Weber | B26D 1/15 83/355 |
| 2007/0151431 | A1* | 7/2007 | Bassler | B26D 7/2621 83/113 |
| 2011/0185865 | A1 | 8/2011 | Weber | |

FOREIGN PATENT DOCUMENTS

| | | |
|---|---|---|
| DE | 199 36 213 B4 | 12/2005 |
| EP | 2 045 053 A2 | 4/2009 |

OTHER PUBLICATIONS

German Patent Office Search Report, dated Jan. 16, 2013.
PCT Search Report, dated Jul. 25, 2013.

* cited by examiner

BREAD SLICING MACHINE HAVING AN ADVANCING DEVICE

FIELD OF THE INVENTION

The invention relates to an apparatus for cutting bread having at least one circular blade that rotates in a cutting plane and is guided between a feed section feeding the bread to be sliced to the blade and a removal section receiving the cut slices of bread, and further comprising at least one advancing device that advances the bread from the feed section towards the knife.

BACKGROUND

Such bread slicing machines are known and are mostly used in bakeries for providing customers with fresh-cut bread. A known type of bread slicing machine operates with a circular blade, which rotates in a circular form by means of an eccentric and thereby cuts a slice of the bread that is pushed forward in a slow continuous or timed manner, and emerges from a cutting gap, and subsequently once again plunges into the cutting gap. The cut bread can be taken out of the machine and placed on a so-called "guide," in order to pull a bag over the slice packet.

With such known bread slicing machines, it is disadvantageous that the uniform removal of the cut slices from the blade is not yet optimally ensured. A known solution proposes providing an inclined plane in the removal section, onto which the cut slices slip off of the blade. However, such a removal is not reliable to the desired extent.

SUMMARY OF THE INVENTION

It is a task of the present invention to provide a bread slicing machine that features improved removal characteristics for the cut slices. Additional objects and advantages of the invention will be set forth in part in the following description, or may be obvious from the description, or may be learned through practice of the invention.

The objects are solved with a bread slicing machine in the aforementioned manner through the characteristics of the appended claims.

In accordance with the first aspect, the advantages of the invention are to be seen in that the advancing device, which pushes the bread to be cut to the blade and presses into the removal section the last cut slice through the exposed front end of the bread by the path line of the thickness of the next slice to be cut, is also designed for the purpose of pressing the last cut slice further into the removal section, in order to prevent a build-up at the blade. Depending on the need (length of bread, type of bread, etc.), this additional advance line may vary in length. Following this additional advance, the bread to be sliced is drawn back in the direction of the feed section, until only one bread section of the thickness to be cut is still in the removal section, and the next step can then be carried out. In accordance with the advance under the invention, the bread may be withdrawn by an additional line, including by more than this line, and then a piece may again be pushed far forward, so that a slice of the desired thickness "d" is then cut. This can benefit from a more uniform thickness d of the successively cut slices.

Accordingly, the advancing device—controlled by an electronic controller—undertakes an oscillating motion, by initially traveling an advance path "v" in the direction of advance, which is composed of the slice thickness d and the additional path section "x" (the additional advance path), and the subsequent path line traveled in the opposite direction of size x and/or a slightly greater path line x+s with a subsequent advance by the path line "s". Thus, the net advance path corresponds to the slice thickness d, such that, upon this positioning of the bread, a slice can be cut with the thickness d.

Thus, the invention makes it possible for the advancing device to push the uncut bread between two cutting instances across the cutting plane such that this pushes at least the last cut slice, preferably all previously cut slices, in the direction of advance of the bread. Within the framework of this invention, the cutting plane of the blade is used as a reference value for the advance lines, since the circular blade is not an accurate reference, because of its finite dimensions.

A further modification of the invention is characterized by the fact that the two cutting instances, in which the advancing device moves the cut surface of the bread initially forward and then back, follow each other. This ensures a constant advance of the slice packet after each cutting instance. Alternatively, the additional advance is not triggered after each cutting, i.e. as an addition to the advance by the slice thickness d, but is triggered, for example, only after each second cut. Additional variations, even within the cutting of the bread, are possible. As an example, it can be provided that, upon the cutting of the second half of the bread, the additional advance movement is carried out more frequently than during the cutting of the first half of the bread, since more propulsive force must be applied as more slices have already been cut.

Advantageously, the additional advance path x amounts to at least 2 mm, preferably at least 4 mm, preferentially at least 6 mm. In other words, the entire advance path v, measured from the cutting plane of the blade, amounts to at least 2 mm plus the predetermined slice thickness d or preferably at least 4 mm plus the slice thickness d, etc. Here, the desired additional advance path along with the time required for traveling the forward and reverse path along with (if applicable) the inertia of the advancing device must be taken into account. Larger unnecessary path lines should be avoided.

The advantages in accordance with the second aspect of the invention consist in particular of the fact that, with the assistance of the advancing device, a compacting of the blade may be undertaken in the removal section, in order to not have to push the bread together first by hand into the removal section and/or in order to prepare the lifting out of the removal section by means of a lifting table.

The advance line at the end of the overall cutting instance beyond the cutting level may, depending on the bread length and design of the apparatus, amount to several centimeters. The advance line "t" may be automatically calculated in advance, by determining the bread length in the apparatus through corresponding measuring equipment (optical stop sensors such as buttons, etc.) and calculating the advance line t on the basis of the measurement results and traveling after the slicing.

Particularly preferentially, the advancing device in accordance with the invention features fixing means, in order to fix the bread at the end away from the blade and advance the bread against the blade. The fixing means preferably comprise a claw that is able to swivel upwards and downwards, which plunges at the end of the bread away from the blade prior to the beginning of the cutting instance and is released from the last slice after the end of the cutting instance.

The fixing means are preferably arranged on a sliding arm, which is in turn advantageously shiftable along the track in and counter to the direction of advance of the bread.

This design is easy to carry into effect; a stepper motor with a reversible direction of rotation can be readily employed.

According to a preferential further modification of the invention, an essentially vertically running rigid wall, which is preferably fixed in relation to the bottom, rises towards the edge of the bottom of the removal section. The upper edge of the wall runs along the bread cutting width at the same level, or below the bread contact face of the bottom of the feed section. The wall rising from the bottom of the removal section prevents the bottom slice area of the slice that was last cut and, at that point, is lying flat against the wall—i.e., prior to the advance of the loaf at the beginning of the next step—from being pushed back from the previously cut slices against the blade. The subsequent advance by the load then conveys the slice packet away from the wall, so that a clean cutting and removal process can be achieved. The following cut slice then has enough space to be separated from the previously cut loaf without any obstruction. The additional advance of the advancing device in accordance with the inventions supports this process and assists in preventing a build-up between the slice packet and the wall.

Advantageously, the rigid wall is designed in one piece with the bottom of the removal section. Thereby, it is preferential if the rigid wall forms an upwards elbowed section of the bottom of the removal section. The thickness of the wall is preferably less than that of a slice of bread with a normal thickness of 8-12 mm. Thereby, the wall thickness advantageously amounts to less than 5 mm, preferably less than 3 mm, so that the cut slice does not fall on the upper edge of the wall, but in the gap between the previously cut slice and the wall. Furthermore, it has proved to be advantageous if the wall has a height of 5 mm up to 20 mm, while the difference in height between the surfaces of two bottoms amounts to between 5 mm and 25 mm. Thereby, the difference in height between the bottom of the feed section and the bottom of the removal section is measured.

Advantageously, the apparatus in accordance with the invention features an end stop for the first cut slice in the removal section, which also proceeds, so that this slice always lies flat against the end stop. The end stop also moves in accordance with the bread transport cycle, whereas the path line of the end stop per cycle is preferably slightly larger than the path line that the bread (net) travels per cycle. Thereby, the larger expansion of the slice packet in the direction of advance, compared to the uncut state, is taken into account.

The invention also relates to a method for cutting and transporting bread in a bread cutting apparatus, whereas this apparatus features the aforementioned characteristics. According to the method in accordance with the invention, the bread after cutting is advanced by a slice by more than one slice thickness, in order to push the cut slice(s) further into the removal section. Subsequently, the uncut bread is withdrawn until only one slice thickness protrudes in the removal section. Then, the blade may cut the corresponding slice. According to the second aspect of the invention, the remaining bread that is no longer to be cut is pushed across the cutting plane until the bread slice packet is pushed together between an end stop at the side away from the blade and the aforementioned remaining bread such that it subsequently can be manually removed from the apparatus and still driven upwards by a lifting table.

According to one aspect of the invention that is to be considered independent, the claw is pulled from the last slice only if the slice packet is pressed together. In this case, the end of the bread lies flat against the adjacent slice under such high friction that it is not taken along upwards by the claw. This enables a trouble-free automatic release of the claw from the last slice. As an alternative or in addition—and likewise representing its own aspect of the invention—the bread is held not only by a claw (among other things), but is held peripherally on its top side, preferably transverse to the direction of advance of the bread.

Advantageous additional forms of the invention are identified by the characteristics of the claims.

BRIEF DESCRIPTION OF THE DRAWINGS

The invention is described in more detail in the figures below. The following are shown.

DETAILED DESCRIPTION

Figure 1:
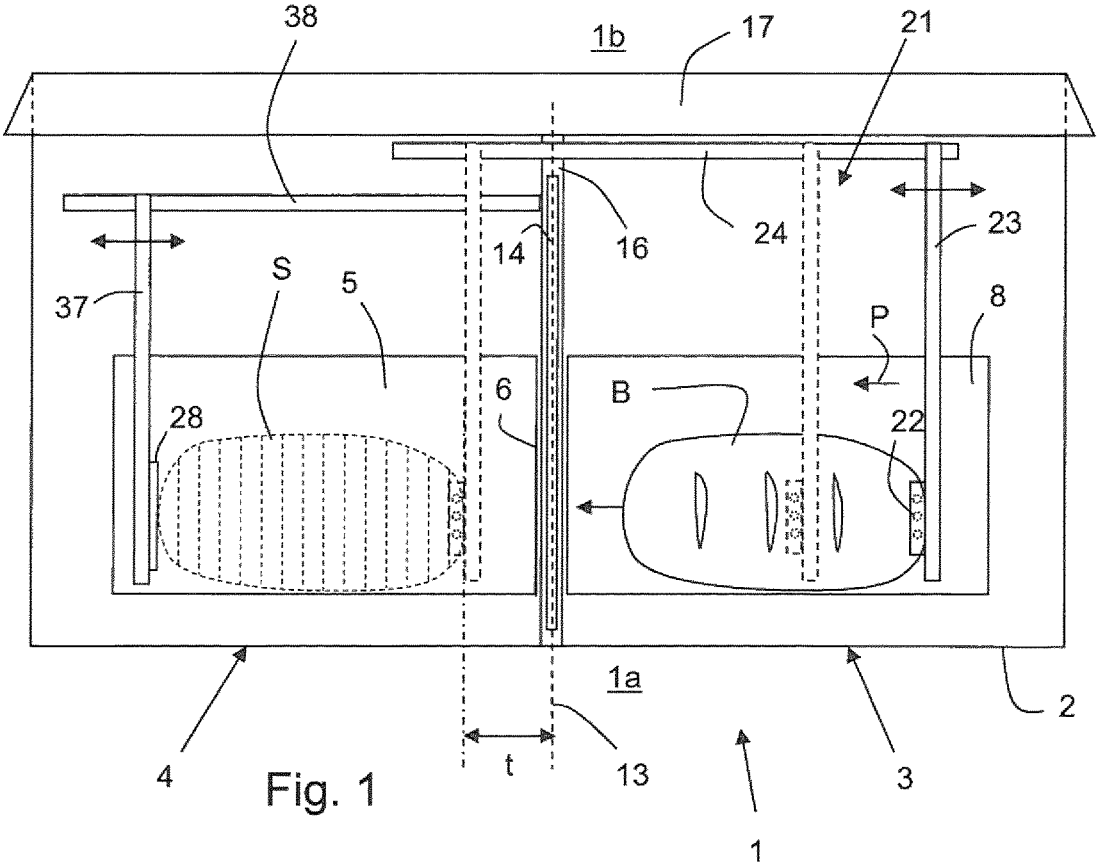
FIG. 1 a top view of a first embodiment of a schematically represented cutting apparatus in accordance with the invention.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

Figure 2:
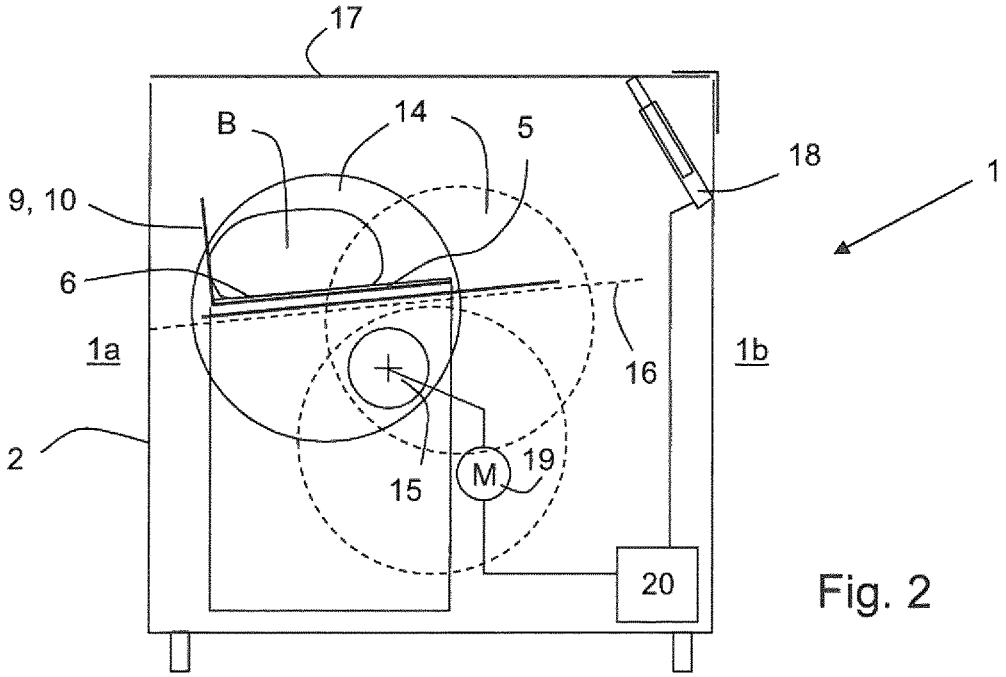
FIG. 2 a schematic front side view of the embodiment according to FIG. 1 in cutting operation.

A first embodiment of a cutting apparatus 1 in accordance with the invention is presented in FIGS. 1 and 2. FIG. 1 schematically shows a top view of the apparatus 1 with a housing 2, in which, in particular, a feed section 3 and a removal section 4 are provided, and which is able to be closed by a hood 17. The feed section 3 comprises a bottom 8, which is preferably made of stainless steel, with a level receiving surface, on which the bread B to be cut is laid.

Furthermore, in the feed section 3, a claw 22 that is able to swivel up and down is coupled with—in this case—three prongs on an advancing arm 23, which runs perpendicular to the direction of advance (see arrow P) (see also the further details in FIGS. 3-6). Through manual or automatic swiveling downwards, the claw 22 is pressed into the end of the loaf B turned towards it. The advancing arm 23 and the attached claw 22 are able to be driven through motor operation (motor not shown) along a linear track 24 running in a direction of advance (arrow P), in order to push the bread B in the direction of a circular blade 14. Before inserting a new loaf, the advancing arm 23 is driven back into its initial position (the two movements are indicated by the double arrow in FIG. 1). In FIG. 1, there are three different positions of the advancing arm 23: in solid lines, the starting position is shown, while a middle and the end position after the termination of the cutting instance are portrayed in dashed lines.

The claw 22, the advancing arm 23, the track 24 and the feed motor (not shown) are components of an advancing device 21 for transporting the bread B from the feed section 3 to the blade 14. Additional details of the advancing device 21 are more accurately represented in FIGS. 3-6. The claw 22 rests in a cube-shaped claw housing 25 (omitted in FIG. 1 for the sake of clarity) which, at its side turned towards the bread B, features openings (not visible in the side view) for each prong of the claw 22. The prongs step through these openings if the bread is clutched prior to the beginning of the cutting (see double arrow in FIG. 3). The claw 22 is also connected to a shaft 26 (also not shown in FIG. 1), which runs parallel to the advancing arm 23 and may also swivel the claw 22 by means of the motor that is not shown. The end of the bread covered by of the claw 22 lies partly, penetrating a lower recess of the claw housing 25, in the claw housing 25, whereby it is fixed even better. Moreover, the upper edge of the recess holds tight the end of the bread that is fixed in such a manner, if, after the termination of the cutting process, the claw 22 is pulled upwards from the top end of the bread.

The circular blade 14 moves in a vertical cutting plane 13 and, when rotating from a gap 16, which separates the feed section 3 from the removal section 4, drives out and back into it. In this case, the cutting plane 13 is used as a reference point for the advance lines of the claw 22 and/or the bread B to be depicted, since the circular blade 14 naturally features finite dimensions, including a mostly non-linear cutting phase, and therefore does not represent an exact reference.

As can be seen in the schematic presentation in accordance with FIG. 2, in which many parts are not shown for the purpose of better clarity, the circular blade 14 is eccentrically mounted at a shaft 15, and is powered by a motor 19 controlled with a controller 20. In FIG. 2, as an example, three different positions of the circular blade 14 are shown, two of which with dashed lines. In particular, how the circular blade 14 is able to cut the bread B into slices is to be recognized. The exact eccentric mechanism is not shown; however, the corresponding structures are familiar to an expert. In this case, they are not essential to the invention.

With the embodiment that is shown, the removal section 4 comprises a bottom 5, which preferably consists of stainless steel and, just like the bottom 8, is inclined with respect to a horizontal plane at the front machine side 1*a* (see FIG. 2; not shown in FIG. 1). On the operator side or the front machine side 1*a* outward, a side support 9 for the slices S rises in the area of the front edge of the bottom 5. In this case, the side support 9 is inclined with respect to a vertical plane at the front side 1*a* (see FIG. 2). Thereby, the support surface 5 and the side support 9 are essentially perpendicular to each other. Likewise, the feed section 3 features a corresponding side support 10, which runs in the same plane as the side support 9 (see FIGS. 1 and 2).

In FIGS. 1-2, a pneumatic cylinder 18 is also shown; with this, the hood 17 can be opened and closed. In this case, the pneumatic cylinder 18 is attached to the controller 20 (details not shown), in order to, for example, open the hood 17, if the cutting instance is complete. On the contrary, if the blade 14 is running, the hood 17 cannot be open.

Also shown is an end stop 28 for the first cut slice, which upon the beginning of the cutting instance is positioned very close to the blade 14 and, with the assistance of an arm 37 driven by a motor (not shown) running vertically to the direction P, is shifted along a track 38 running in the direction P, together with the claw 22 in the common mode by the nearly equal or a slightly bigger path and in the same direction. The first cut slice S falls against the end stop 28, thus ensuring the holding together of the slice packet. In FIG. 1, the end stop 28 at the end of the cutting instance is shown. The double arrow in the removal section 3 indicates that the end stop is driven near the blade 14 prior to the first cut.

Figure 4:
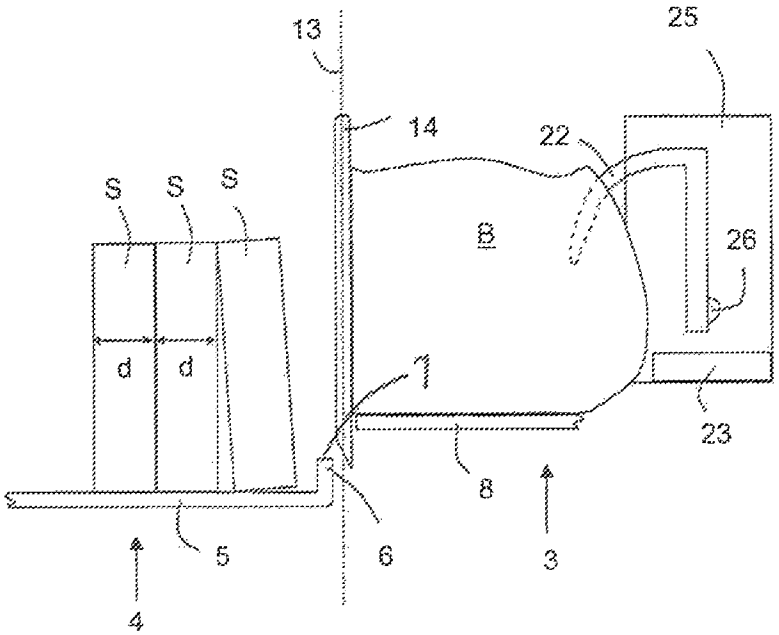
FIG. 4 a schematic front view of that shown in FIG. 3, showing the deposit of the cut slice.
Figure 3:
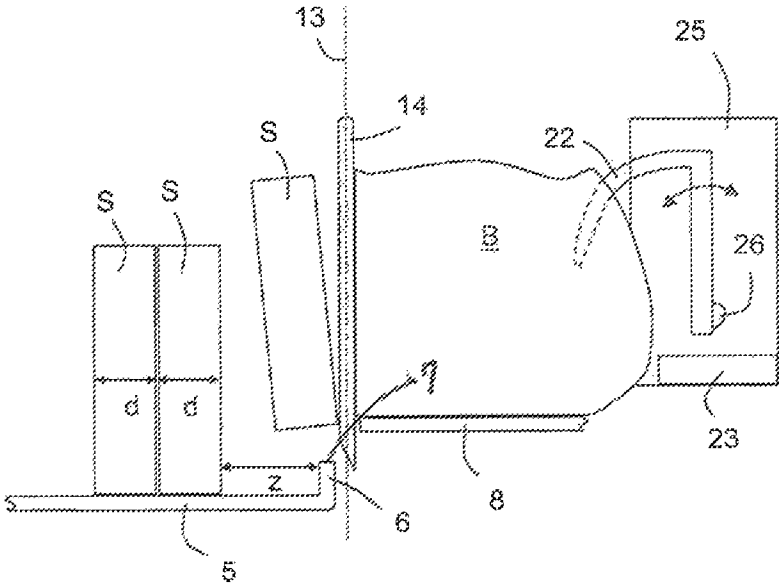
FIG. 3 a schematic front view of a detail of the cutting device, showing the cutting off of a slice.
Figure 6:
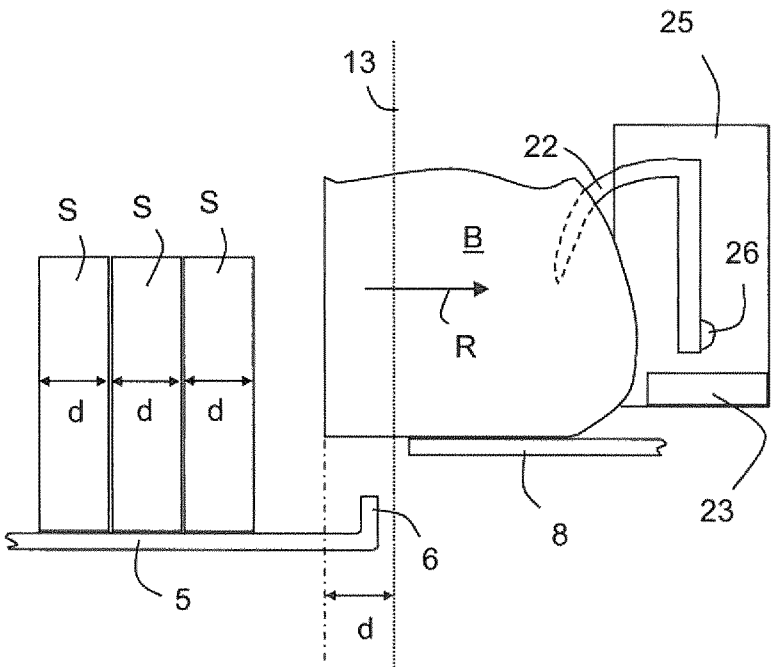

According to the embodiment shown in the figures, the bottom 5 is elbowed upward to the blade 14, such that a wall 6 is formed, which runs parallel to the circular blade 14 and—upon cutting into slices—features a horizontal spacing from it of not more than a few millimeters (see FIGS. 3 and 4). In this case, the height of the wall 6 amounts to approximately 5-20 mm. The wall thickness—if it is in one piece, with the bottom 5—preferably amounts to approximately 2-3 mm, depending on the choice of stainless steel sheet metal of the bottom 5. The upper edge 7 of the wall 6 lies either at the height of the bread contact face of the bottom 8 or below it. In the latter case, a horizontal gap between the upper edge of the wall 7 and the underside of the bottom 8 can be formed, which are arranged in a manner offset on the side against each other, i.e. in a horizontal direction.

The rigid wall 6, firmly connected to the bottom 5, prevents the last cut slice S from being pushed in the direction of the gap 16. This is not necessarily the case, but if it does occur, it can significantly disrupt the operation of the cutting device. In this case, the slice S is pressed against the wall 6, and this can be supported on the side. Thus, this slice S cannot arrive either in the direction of the loaf B or in the cutting gap 16. Thus, a secure and rapid cutting sequence is ensured. The length of the wall in the cutting direction is advisably viewed at least as large as the greatest bread width, which is to be cut with the apparatus in accordance with the invention. However, this is not mandatory; shorter lengths can also serve the same purpose.

In accordance with the invention, the advancing device 21 is designed in such a manner that, on the one hand, it can advance and withdraw the loaf B between two—not necessarily consecutive—cutting instances (first aspect of the invention) and, on the other hand, can push together the cut slices S in the removal section 4 after the cutting of the complete bread B (second aspect of the invention).

In FIGS. 3-6, four different snapshots during a cutting cycle are shown. How the circular blade 14—controlled by the controller 20—cuts a slice S from the loaf B is shown in FIG. 3. Thereby, the blade 14 emerges from the gap 16 and penetrates the loaf B on the top from the side. The slice S is slightly inclined to the removal section 4, and then falls into the gap of the length z, which is formed by the previously cut slice S and the wall 6. There, the last cut slice S, through which the cutting and the discharge may be slightly inclined, stands up on the bottom 5 (FIG. 4).

Figure 5:
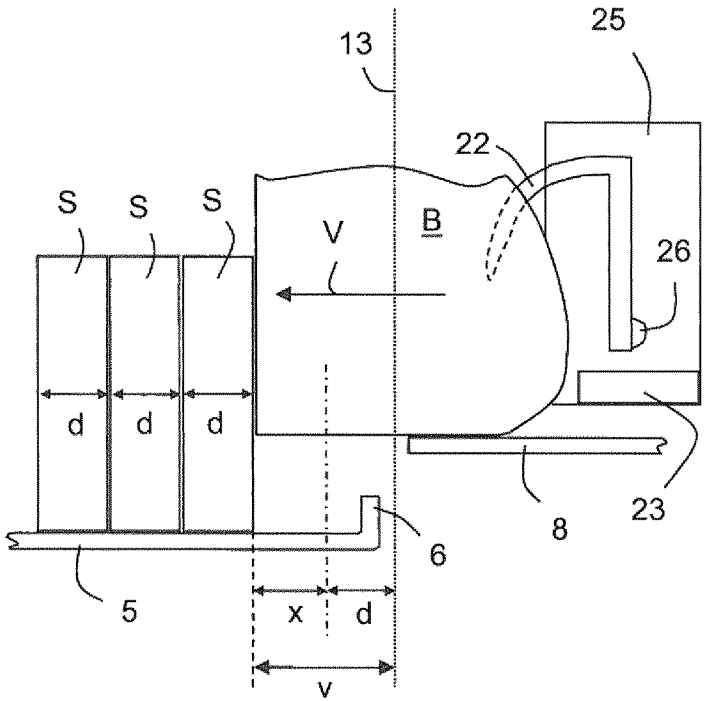
FIG. 5 a schematic front view of that shown in FIGS. 3 and 4, showing the advance of all cut slices, and FIG. 6 a schematic front view of that shown in FIGS. 3-5, showing the return of the bread.

In accordance with the invention, at that point, the advancing device 21 pushes the loaf B by a line v in the direction of the removal section 4 (see arrow V in FIG. 5). In the meantime, the blade 14 is once again submerged in the gap 16. The advance line v is larger than the predetermined slice thickness d (see FIG. 5) by the line x. Thereby, the already cut slices S are likewise advanced in the direction V, in an ideal system likewise by the line x, which in the normal case amounts to several millimeters (for example, 8-12 mm). Since the slice packet naturally features a greater length than in its uncut state, only the advance line v of the bread can be precisely defined. However, it is essential that, between the last cut slice S and the uncut bread B, a gap arises that is sufficiently larger than the slice thickness d predetermined for the machine, which was entered by the user or set in the machine.

The large advance by the line v serves the purpose of ensuring a secure, unimpeded discharge of the following slice S, without other means of removal (inclined plane in the direction of advance, additional vibrators in the removal area, other active devices for slice transport, etc.) being necessary—but these may be present. In particular, the bottom 5 may run horizontally in the direction of advance V, as shown in FIGS. 3-6.

In the embodiment that is shown, it must be added that the wall 6 must likewise still be bridged by the slice that was just cut, so that it can fall into the gap of the length z (see FIG. 3). In this case, the additional advance path x is thus advisably larger than the thickness of the wall 6 plus the spacing of this wall 6 from the blade 14, which can amount to a total 3-4 mm. In this manner, it can be ensured that the slices S are securely and rapidly removed; this includes the avoiding of the jamming of the last cut slices in the gap 16.

In order to cut the next slice S from the loaf B, the loaf B is withdrawn with the assistance of the advancing device 21 by the line x (see arrow R in FIG. 6), such that the bread B still projects only by the slice thickness d across the cutting plane 13. At that point, a slice S of such thickness d can be cut, as is shown in FIG. 3. A cutting cycle is thereby completed.

By contrast, the known cutting apparatus further cuts the bread B solely by the predetermined slice thickness d, in order to then cut the next slice S. In doing so, appropriate tools are often necessary to create the sufficient space for the next upcoming slice.

The second aspect of the invention can be seen in FIG. 1. FIG. 1 shows the left half of the complete slice packet in dashed lines. The advancing device 21 designed in accordance with the invention pushes the last slice still held by the claw 22 across the cutting plane 13 counter to the remaining slices S, until the slice packet is compacted between the end stop 28 and the last clawed slice; thus, there are no significant gaps between the individual slices S. The advance line t, which travels from the arm 23 and the claw 22 (also shown in dashed lines), may amount to several centimeters, but may be even smaller. The advance line t may be automatically calculated in advance, by measuring, in particular, the bread length to be cut in the apparatus automatically by means of corresponding sensors and calculating the advance line t on the basis of the measurement results.

Not only the advancing device 21, but also the end stop 28, can be moved within the framework of the pushing together of the slices S, namely in the opposite direction of the movement of the claw 22 or, on the other hand, in the same direction as the claw 22. In the latter case, of course, the claw must travel a larger path. It is essential that, at the end of the advancing process, the slices S are pushed together in a compacted form, and then—after the preferably automatically controlled opening of the hood 17—are removable from the removal section 4 easily as a whole, i.e. without the slices themselves having to be pushed together. Alternatively, a lifting table is provided that lifts the slice packet out of the removal section 4, so that the operator need not bend over the removal section 4. In this case, the prescribed compacting also serves the purpose of positioning the slice packet, so that no slices of a loose slice packet fall back from the lifting table into the removal section.

Moreover, in the compacted state of the slice packet, the claw 22 can be pulled from the last slice S without dragging along the slice, since, because of friction, it remains in the slice packet. This mechanism also functions in the event that a claw that can be swiveled is not used, but, for example, a horizontally movable claw or fork is used. In addition, the recess in the claw housing 25 prevents the end of the bread from being picked up by the claw 22 when it is pulled out.

The processes described above, both for the oscillating push—advance by the line v, withdrawal by the line x (or withdrawal by the line x+s and then advance once again by the line s)—and the advance at the end of the entire cutting instance, are preferentially undertaken by the controller 20. Other control concepts, particularly those with decentralized controllers, are readily possible.

The invention is not limited to the embodiment that is shown. Variations are possible at any time within the framework of the patent claims. Thus, for example, it is not absolutely necessary to carry into effect the additional advance by the advance path x after each step. For example, the advancing device 21 may bring about the additional advance x only after each second or third step. Further variations of additional advances in regard to the times of advance and the lengths of advance, in relation to the times of cutting the length of advance, are readily within the scope of this invention. For example, it is possible for the advancing device 21 to carry into effect a non-constant additional advance x, which varies the advance path v, for example as a function of the remaining amount of bread to be cut. For example, the path x may be larger with a decreasing remaining bread length. Moreover, for the advancing device 21 designed in accordance with the invention, additional transport devices for the bread and/or the slices are possible within the framework of the invention, whereas both passive and active means of transport come into question (the inclined plane shown in FIG. 2 is a passive means of transport).

The invention claimed is:

1. An apparatus for cutting bread into slices, comprising;

a feed section disposed for receipt of an uncut bread;

a removal section disposed downstream of the feed section in a conveyance direction (P) of the uncut bread for removal of cut bread after slicing;

a circular blade that rotates in a cutting plane in a gap between the feed section and the removal section;

an advancing device disposed to advance the uncut bread along the conveyance direction from the feed section to the blade, wherein the advancing device includes a claw for clamping the uncut bread and a motor for linearly driving the bread along the conveyance direction (P);

an electronic controller for controlling the circular blade and the advancing device; and wherein, the electronic controller is configured so that between slicing sequences of the uncut bread, the advancing device is controlled by the electronic controller to move in the conveyance direction (P) to a first position to advance the uncut bread across the cutting plane of the blade by an advance patch (v) that is greater than a predetermined slice thickness (d), and to subsequently move in a second direction counter to the conveyance direction (P) to a second position to withdraw the uncut bread so that a slice is subsequently cut from the uncut bread having the predetermined slice thickness (d).

2. The apparatus as in claim 1, wherein the controller is configured so that the advancing device is controlled to push a last cut slice of the bread in the conveyance direction (P) as the advancing device moves to the first position.

3. The apparatus as in claim 2, wherein the controller is configured to move the advancing device to the first position and then to the second position in sequential steps.

4. The apparatus as in claim 2, wherein the controller is configured to move the advancing device to the sequential first and second positions between non-consecutive slicing sequences of the uncut bread.

5. The apparatus as in claim 1, wherein the advance path (v) is measured from the cutting plane and greater than the predetermined slice thickness (d) by at least 6 mm.

6. The apparatus as in claim 1, further comprising an end stop in the removal section against which a first slice from the uncut bread is pressed by advancement of subsequent slices by the advancing device.

7. An apparatus for cutting bread into slices, comprising;

a feed section disposed for receipt of an uncut bread;

a removal section disposed downstream of the feed section in a conveyance direction (P) of the uncut bread for removal of cut bread after slicing;

a circular blade that rotates in a cutting plane in a gap between the feed section and the removal section;

an advancing device disposed to advance the uncut bread along the conveyance direction from the feed section to the blade, wherein the advancing device includes a claw for clamping the uncut bread and a motor for linearly driving the bread along the conveyance direction (P);

an electronic controller for controlling the circular blade and the advancing device; and wherein the electronic controller is configured so that between each slicing sequence of the uncut bread, the advancing device is controlled by the electronic controller to move in the conveyance direction (P) to a first position to advance the uncut bread across the cutting plane of the blade by an advance patch (v) that is greater than a predetermined slice thickness (d) and then immediately retract the uncut bread in a second direction counter to the conveyance direction (P) to position the bread to undergo a slicing sequence resulting in a slice of bread having the predetermined slice thickness (d) cut from the uncut bread.

* * * * *